US009845446B2

(12) United States Patent
Bauer et al.

(10) Patent No.: US 9,845,446 B2
(45) **Date of Patent: *Dec. 19, 2017**

(54) MIXTURES, THEIR PREPARATION, AND USES

(71) Applicant: BASF SE, Ludwigshafen (DE)

(72) Inventors: Frederic Bauer, Deidesheim (DE); Rainer Eskuchen, Langenfeld (DE); Juergen Tropsch, Roemerberg (DE); Carsten Sueling, Frankenthal (DE)

(73) Assignee: BASF SE, Ludwigshafen (DE)

( * ) Notice: Subject to any disclaimer, the term of this patent is extended or adjusted under 35 U.S.C. 154(b) by 37 days.

This patent is subject to a terminal disclaimer.

(21) Appl. No.: 14/771,669

(22) PCT Filed: Mar. 13, 2014

(86) PCT No.: PCT/EP2014/054911

§ 371 (c)(1),
(2) Date: Aug. 31, 2015

(87) PCT Pub. No.: WO2014/146958

PCT Pub. Date: Sep. 25, 2014

(65) Prior Publication Data

US 2016/0010027 A1 Jan. 14, 2016

(30) Foreign Application Priority Data

Mar. 22, 2013 (EP) ..... 13160613

(51) Int. Cl.

| | |
|---|---|
| ***C11D 1/825*** | (2006.01) |
| ***C11D 3/22*** | (2006.01) |
| ***B08B 3/04*** | (2006.01) |
| ***C11D 1/66*** | (2006.01) |

(52) U.S. Cl.
CPC ..... *C11D 1/662* (2013.01); *C11D 1/825* (2013.01)

(58) Field of Classification Search
CPC ..... C11D 1/825; C11D 3/22; B08B 3/04
See application file for complete search history.

(56) References Cited

U.S. PATENT DOCUMENTS

| | | | | |
|---|---|---|---|---|
| H000171 | H * | 12/1986 | McDaniel | C11D 1/662 510/470 |
| 2003/0181347 | A1* | 9/2003 | Johansson | A61K 8/068 510/417 |
| 2012/0245070 | A1 | 9/2012 | Eskuchen et al. | |
| 2013/0303430 | A1 | 11/2013 | Reinoso Garcia et al. | |

FOREIGN PATENT DOCUMENTS

| | | | |
|---|---|---|---|
| DE | 199 33 404 | 1/2001 | |
| EP | 2 336 280 | 6/2011 | |
| WO | WO 94/21655 | * 10/1994 | C07H 15/04 |
| WO | 95 09605 | 4/1995 | |

OTHER PUBLICATIONS

U.S. Appl. No. 14/765,461, filed Aug. 3, 2015, Bauer et al.
International Search Report dated Jun. 4, 2014 in PCT/EP14/054911 Filed Mar. 13, 2014.

* cited by examiner

*Primary Examiner* — Brian P Mruk
(74) *Attorney, Agent, or Firm* — Oblon, McClelland, Maier & Neustadt, L.L.P.

(57) ABSTRACT

The current invention is directed towards mixtures, comprising (A) in the range of from 15 to 85% by weight of at least one compound of the general formula (I) (B) in the range of from 85 to 15% by weight of at least one compound of the general formula (II), wherein the integers are defined as follows: $R^1$ is $C_3$-$C_4$-alkyl, linear or branched, $R^2$ is $C_5$-$C_6$-alkyl, linear or branched, $G^1$, $G^2$ are different or identical and selected from monosaccharides with 4 to 6 carbon atoms, x, y are numbers in the range of from 1.1 to 4, $R^3$ is $C_3$-$C_9$-alkyl, linear or branched, the percentages referring to the total mixture.

(I)

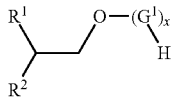

(II)

18 Claims, No Drawings

MIXTURES, THEIR PREPARATION, AND USES

The current invention is directed towards mixtures, comprising (A) in the range of from 15 to 85% by weight of at least one compound of the general formula (I)

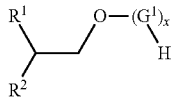

(I)

(B) in the range of from 85 to 15% by weight of at least one compound of the general formula (II), $$R^3—CH_2—O-(G^2)_y-H \quad (II)$$

wherein the integers are defined as follows:

$R^1$ is $C_3$-$C_4$-alkyl, linear or branched, $R^2$ is $C_5$-$C_6$-alkyl, linear or branched, $G^1$, $G^2$ are different or identical and selected from monosaccharides with 4 to 6 carbon atoms, x, y are numbers in the range of from 1.1 to 4

$R^3$ is $C_3$-$C_9$-alkyl, linear or branched, the percentages referring to the total mixture, and compound (A) being different from compound (B).

Furthermore, the present invention is directed towards the use of mixtures, and to a process for making mixtures.

When cleaning surfaces such as hard surfaces or fibers with aqueous formulations several problems have to be solved. One task is to solubilize the dirt that is supposed to be removed and to keep it in the aqueous medium. Another task is to allow the aqueous medium to come into contact with the surface to be cleaned. A particular purpose of such hard surface cleaning can be degreasing. Degreasing as used in the context with the present invention refers to the removal of solid and/or liquid hydrophobic material(s) from a respective surface. Such solid or liquid hydrophobic material may contain additional undesired substances such as pigments and in particular black pigment(s) such as soot.

Some alkyl polyglycosides ("APG") such as described in WO 94/21655 are well known for degreasing lacquered or non-lacquered metal surfaces.

Formulations prepared for cleaning hard surfaces are expected to have a long shelf-life. They should form stable aqueous formulations, selected from stable emulsions, stable colloidal solutions or stable aqueous solutions. Stable aqueous formulations are defined as aqueous formulations that neither break nor form turbidity under the respective storage conditions. However, the lifetime of some aqueous formulations of alkyl polyglycosides such as of 2-n-propylheptyl glucosides leave room for improvement. On the other hand, alkyl polyglycosides are surfactants that exhibit a high wettability and they are thus highly attractive products.

It was therefore an objective of the present invention to provide a formulation that exhibits a long shelf-life and excellent degreasing properties. It was further an objective to provide a method for making a formulation that exhibits a long shelf-life and excellent degreasing properties. It was further an objective to provide a method of use of formulations that exhibit a long shelf-life and excellent degreasing properties.

Accordingly, the mixtures defined in the outset have been found, them being also referred to as mixtures according to the invention.

Mixtures according to the invention comprise (A) in the range of from 15 to 85% by weight, preferably 20 to 80% by weight, more preferably 20 to 55% by weight of at least one compound of the general formula (I)

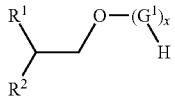

(I)

briefly also referred to as compound (A), (B) in the range of from 85 to 15% by weight, preferably 80 to 20% by weight, more preferably 55 to 20% by weight of at least one compound of the general formula (II), $$R^3—CH_2—O-(G^2)_y-H \quad (II),$$

briefly also referred to as compound (B), wherein the integers are defined as follows:

$R^1$ is $C_3$-$C_4$-alkyl, linear or branched, $C_3$-alkyl being selected from n-propyl and isopropyl, and $C_4$-alkyl being selected from n-butyl, isobutyl and sec.-butyl.

$R^2$ is $C_5$-$C_6$-alkyl, linear or branched, $C_5$-alkyl being selected from 2-methylbutyl, n-pentyl, sec.-pentyl, 3-methylbutyl, and $C_6$-alkyl being selected from n-hexyl, iso-hexyl, 1-methylpentyl, 2-methylpentyl, 3-methylpentyl, 4-methylpentyl, 2-ethylbutyl, 3-ethylbutyl, preference being given to n-pentyl, 3-methylbutyl, and n-hexyl, particular preference being given to n-pentyl and n-hexyl.

$G^1$, $G^2$ are different or identical and selected from monosaccharides with 4 to 6 carbon atoms, for example tetroses, pentoses and hexoses, x, y are numbers in the range of from 1.1 to 4, preferred are numbers in the range of from 1.1 to 2 and particularly preferred are numbers in the range of from 1.15 to 1.9, $R^3$ is $C_3$-$C_9$-alkyl, linear or branched, the percentages referring to the total mixture according to the invention.

In the course of the present invention, compounds of the general formula (I) can also be referred to as component (A) or compound (A). Furthermore, in the course of the present invention, compounds of the general formula (II) can also be referred to as component (B) or compound (B).

For the purpose of the present invention, compound (A) and compound (B) are different from each other. In one embodiment of the present invention, compound (A) and compound (B) are isomers. In another embodiment of the present invention, compound (A) and compound (B) are not isomers but differ in the number of carbon atoms in $R^1$ and $R^2$ or in different monosaccharides $G^1$ and $G^2$. For the purpose of the present invention, compound (A) and compound (B) are not merely considered different if they have a different degree of polymerization of $G^1$ and $G^2$, the molecules otherwise being identical.

Alkyl polyglycosides such as compound (A) and compound (B) are each usually mixtures of various compounds that have a different degree of polymerization of the respective saccharide. It is to be understood that in formulae (I) and (II), x and y are each number average values, preferably calculated based on the saccharide distribution determined by high temperature gas chromatography (HTGC), e.g. 400° C., in accordance with K. Hill et al., Alkyl Polyglycosides, VCH Weinheim, New York, Basel, Cambridge, Tokyo, 1997, in particular pages 28 ff., or by HPLC. If the values obtained by HPLC and HTGC are different, preference is given to the values based on HTGC.

In one embodiment of the present invention, mixtures according to the invention contain one compound (A).

In one embodiment of the present invention, mixtures according to the invention contain more than one compound (A), for example three or two different compounds (A). In the context of the present invention, different compounds (A) are not merely considered different if they have a different degree of polymerization of $G^1$, the molecules otherwise being identical.

In the case that mixture according to the invention contains more than one compound (A), the percentage refers to the sum of all compounds (A).

In one embodiment of the present invention, mixtures according to the invention contain one compound (B).

In one embodiment of the present invention, mixtures according to the invention contain more than one compound (B), for example three or two different compounds (B). In the context of the present invention, different compounds (B) are not merely considered different if they have a different degree of polymerization of $G^2$, the molecules otherwise being identical.

In the case that mixture according to the invention contains more than one compound (B), the percentage refers to the sum of all compounds (B).

In one embodiment of the present invention, $R^1$ and $R^2$ are selected independently from each other.

In a preferred embodiment of the present invention, $R^1$ and $R^2$ are selected interdependently from each other. For example, if $R^1$ is selected from $C_3$-alkyl, linear or branched, then $R^2$ is selected from $C_5$-alkyl, linear or branched. In a further example, $R^1$ is selected from $C_4$-alkyl, linear or branched, and $R^2$ is selected from $C_6$-alkyl, linear or branched.

In a particularly preferred embodiment of the present invention, $R^1$ is isopropyl and $R^2$ is $CH_2$—$CH_2$—$CH(CH_3)_2$.

In another particularly preferred embodiment of the present invention, $R^1$ is n-$C_3H_7$ and $R^2$ is n-$C_5H_{11}$.

In one embodiment of the present invention, $G^1$ and $G^2$ are independently selected from each other from monosaccharides, preferably from tetroses, pentoses, and hexoses. Examples of tetroses are erythrose, threose, and erythulose. Examples of pentoses are ribulose, xylulose, ribose, arabinose, xylose and lyxose. Examples of hexoses are galactose, mannose and glucose. Monosaccharides may be synthetic or derived or isolated from natural products, hereinafter in brief referred to as natural saccharides or natural polysaccharides, and natural saccharides natural polysaccharides being preferred. More preferred are the following natural monosaccharides: galactose, arabinose, xylose, and mixtures of the foregoing, even more preferred are glucose, arabinose and xylose, and in particular glucose. Monosaccharides can be selected from any of their enantiomers, naturally occurring enantiomers and naturally occurring mixtures of enantiomers being preferred.

In single molecules of compounds (A) and compounds (B) with 2 or more monosaccharide groups, the glycosidic bonds between the monosaccharide units may differ in the anomeric configuration (α-; β-) and/or in the position of the linkage, for example in 1,2-position or in 1,3-position and preferably in 1,6-position or 1,4-position.

The integers x and y are numbers in the range of from 1.1 to 4, preferred are 1.1 to 2 and in particularly preferred are 1.15 to 1.9. In the context of the present invention, x and y refer to average values, and they are not necessarily whole numbers. Naturally, in a specific molecule only whole groups of $G^1$ or $G^2$, respectively, can occur.

It is preferred that $y \geq x$.

In single molecules, there may be, for example, only one $G^1$ moiety or up to 15 $G^1$ moieties per molecule. As well, in single molecules, there may be, for example, only one $G^2$ moiety or up to 15 $G^2$ moieties per molecule.

In a preferred embodiment of the present invention, compound (A) is selected from 2-propylheptyl glucoside with x being in the range of from 1.1 to 2, and compound (B) is selected from n-butyl glucoside with y being in the range of from 1.1 to 2.

In another preferred embodiment of the present invention, compound (A) is selected from 2-propylheptyl glucoside with x being in the range of from 1.1 to 2, and compound (B) is selected from 2-ethylhexyl glucoside with y being in the range of from 1.1 to 2.

$R^3$ is $C_3$-$C_9$-alkyl, branched or linear. Examples of $R^3$ are n-propyl, isopropyl, n-butyl, 1-methylbutyl, 2-methylbutyl, 3-methylbutyl, iso-penyl, n-hexyl, iso-hexyl, 1-methylpentyl, 2-methylpentyl, 3-methylpentyl, 1-ethylbutyl, n-heptyl, iso-heptyl, 1-methylhexyl, 2-methylhexyl, 3-methylhexyl, 4-methylhexyl, 1-ethylpentyl, 2-ethylpentyl, 3-ethylpentyl, 1-propylbutyl, n-octyl and n-nonyl, preferred examples of $R^3$ are 1-ethylbutyl, $CH(C_2H_5)$—$(CH_2)_3CH_3$ and n-pentyl, n-hexyl, n-heptyl, n-octyl and n-nonyl, particularly preferred are $CH(C_2H_5)$—$(CH_2)_3CH_3$, n-heptyl, and n-nonyl.

In one embodiment of the present invention, each component (A) and (B) are not pure compounds but may contain one or more impurities such as residual alcohol. Residual alcohol with respect to component (A) is alcohol of general formula (III)

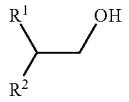

(III)

with $R^1$ and $R^2$ being defined in the same way as $R^1$ and $R^2$ in the respective component (A). Residual alcohol with respect to component (B) is the compound of general formula (IV)

$$R^3—CH_2—O—H \quad \text{(IV)}$$

with $R^3$ being defined in the same way as $R^3$ in the respective component (B). Preferably, each of the components (A) and (B) contain only low amounts of respective residual alcohol. For example, it is preferred that in mixtures according to the invention, component (A) contains in the range of from 50 ppm to 0.5% by weight of residual alcohol, preferably in the range of from 100 ppm to 0.35% by weight and even preferably 200 ppm to 0.3% by weight, referring to the entire component (A). Likewise, in mixtures according to the invention, component (B) contains in the range of from 50 ppm to 0.5% by weight of residual alcohol, preferably in the range of from 100 ppm to 0.35% by weight and even preferably 200 ppm to 0.3% by weight, referring to the entire component (B). For matters of simplicity, in the context of the present invention both components (A) and (B) are computed including their residual alcohol content. The residual alcohol content can be determined, e.g., by high temperature gas chromatography (HTGC).

In one embodiment of the present invention, compound (A) can have a Hazen colour number in the range of from 10 to 1,000, preferably in the range of from 50 to 800 and more preferably in the range of from 100 to 500.

In one embodiment of the present invention, compound (B) can have a Hazen colour number in the range of from 10 to 1,000, preferably in the range of from 50 to 800 and more preferably in the range of from 100 to 500.

The Hazen colour number can be determined according to DIN EN ISO 6271-1 or 6271-2.

In one embodiment of the present invention, compound (A) can have a Gardner colour number in the range of from 0.1 to 8.0, preferably in the range of from 0.5 to 5.0 and more preferably in the range of from 1.0 to 3.5.

In one embodiment of the present invention, compound (B) can have a Gardner colour number in the range of from 0.1 to 8.0, preferably in the range of from 0.5 to 5.0 and more preferably in the range of from 1.0 to 3.5.

The Gardner colour number can be determined according to DIN EN ISO 4630-1 or 4630-2.

Both Hazen and Gardner numbers are determined based on 10% solutions.

In one embodiment of the present invention, in the course of the synthesis of components (A) and (B), alcohols of technical quality are being used instead of pure compounds. It is thus possible that an alcohol of general formula (III) also contains one or more isomers in minor amounts, e. g., up to 20% by weight, referring to compound of the general formula (III). Furthermore, it is possible that an alcohol of general formula (IV) contains minor amounts of isomers, e. g., up to 10% by weight, referring to the respective compound of the general formula (IV). Such minor amounts can be determined by NMR spectroscopy or preferably by gas chromatography.

Mixtures according to the invention are extremely useful for cleaning hard surfaces, and in particular for degreasing metal surfaces. If applied as aqueous formulations, they exhibit a long shelf life.

A further aspect of is a process for making mixtures according to the invention, in brief also being referred to as process according to the invention. The process according to the invention can be carried out by mixing at least one compound (A) with at least one compound (B), in bulk or as preferably aqueous formulation.

The process according to the invention can be carried out by mixing at least one compound (A) with at least one compound (B) as aqueous solutions at temperatures in the range of from 10 to 60° C. or preferably at room temperature. Aqueous formulations can be selected from aqueous dispersions and aqueous solutions, aqueous solutions being preferred. Preferably, mixing is carried out by combining at least one aqueous formulation comprising compound (A) and at least one aqueous formulation comprising compound (B).

In one embodiment of the present invention, the process according to the invention is being carried out by mixing an aqueous solution comprising in the range of from 40 to 60% by weight of compound (A) and at least one aqueous solution comprising in the range of from 55 to 75% by weight of compound (B), at a temperature in the range of from 10 to 60° C.

A further aspect of the present invention is the use of mixtures according to the invention for cleaning hard surfaces or fibers. A further aspect of the present invention is a process for cleaning hard surfaces or fibers by using a mixture according to the invention, said process also being referred to as cleaning process according to the invention. In order to perform the cleaning process according to the invention, it is possible to use any mixture according to the invention as such or—preferably—as aqueous formulation. In such aqueous formulations, it is preferred that they contain in the range of from 35 to 80% by weight of at least one mixture according to the invention.

Hard surfaces as used in the context with the present invention are defined as surfaces of water-insoluble and—preferably—non-swellable materials. In addition, hard surfaces as used in the context of the present invention are insoluble in acetone, white spirit (mineral turpentine), and ethyl alcohol. Hard surfaces as used in the context of the present invention preferably also exhibit resistance against manual destruction such as scratching with fingernails. Preferably, they have a Mohs hardness of 3 or more. Examples of hard surfaces are glassware, tiles, stone, china, enamel, concrete, leather, steel, other metals such as iron or aluminum, furthermore wood, plastic, in particular melamine resins, polyethylene, polypropylene, PMMA, polycarbonates, polyesters such as PET, furthermore polystyrene and PVC, and furthermore, silicon (wafers) surfaces. Particularly advantageous are formulations according to the invention when used for cleaning hard surfaces that are at least part of structured objects. In the context, such structured objects refer to objects having, e. g. convex or concave elements, notches, furrows, corners, or elevations like bumps.

Fibers as used in the context with the present invention can be of synthetic or natural origin. Examples of fibers of natural origin are cotton and wool. Examples of fibers of synthetic origin are polyurethane fibers such as Spandex® or Lycra®, polyester fibers, polyamide fibers, and glass wool. Other examples are biopolymer fibers such as viscose, and technical fibers such as GoreTex®. Fibers may be single fibers or parts of textiles such as knitwear, wovens, or nonwovens.

In order to perform the cleaning process according to the invention formulations according to the invention are being applied. Preferably, formulations according to the invention are applied in their embodiments as aqueous formulations, comprising, e. g., 10 to 99.9% by weight water. Formulations according to the invention can be dispersions, solutions, gels, or solid blocks, emulsions including microemulsions, and foams, preferred are solutions. They can be used in highly diluted form, such as 1:10 up to 1:50.

In order to perform the cleaning process according to the invention, any hard surface or fiber or arrangement of fibers can be contacted (brought into contact) with a formulation according to the invention.

When contacting hard surfaces with formulations according to the invention, formulations according to the invention can be applied at ambient temperature. In a further embodiment, formulations according to the invention can be used at elevated temperatures, such as 30 to 85° C., for examples by using a formulation according to the invention that has a temperature of 30 to 85° C., or by applying a formulation according to the invention to a preheated hard surface, e. g., preheated to 30 to 85° C.

In one embodiment, it is possible to apply a formulation according to the invention to a hard surface under normal pressure. In a further embodiment, it is possible to apply a formulation according to the invention to a hard surface under pressure, e. g., by use of a high-pressure cleaner or a pressure washer.

In one embodiment of the present invention, application duration can be in the range of from one second up to 24 hours, preferably in the range of 30 min to 5 hours in the case of fiber cleaning and preferably one second up to 1 hour in cases such as floor cleaning, kitchen cleaning or bathroom cleaning.

Hard surface cleaning in the context of the present invention can include removing heavy soiling, removing slight soiling and removing dust, even removing small quantities of dust.

Examples of soiling to be removed are not limited to dust and soil but can be soot, hydrocarbons, e.g., oil, engine oil, furthermore residues from food, drinks, body fluids such as blood or excrements, furthermore complex natural mixtures such as grease, and complex synthetic mixtures such as paints, coatings, and pigment containing grease.

The contacting of the hard surface with formulation according to the invention can be performed once or repeatedly, for example twice or three times.

After having performed the contacting the hard surface with formulation according to the invention, the remaining formulation containing soil or dust will be removed. Such removal can be effected by removal of the object with the now clean hard surface from the respective formulation or vice versa, and it can be supported by one or more rinsing step(s).

After having performed the cleaning process according to the invention, the object with the now-clean hard surface can be dried. Drying can be effected at room temperature or at elevated temperature such as, e.g., 35 to 95° C. Drying can be performed in a drying oven, in a tumbler (especially with fibers and with fabrics), or in a stream of air having room temperature or elevated temperature such as 35 to 95° C. Freeze-drying is another option.

By performing the cleaning process according to the invention, hard surfaces can be cleaned very well. In particular, objects with structured hard surfaces can be cleaned well.

In one embodiment of the present invention, formulations according to the invention can contain further organic or inorganic materials.

In one embodiment of the present invention, aqueous formulations according to the invention may further contain at least one by-product, stemming from the synthesis of compound (A) or compound (B).

Such by-products can be, for example, starting materials from the syntheses of compounds (A) and (B) such as the alcohols of formulae $R^1R^2CH—CH_2—OH$ and $R^3—CH_2—OH$, respectively. Examples of further by-products from the syntheses of compounds (A) and (B) are oligomers and polymers of monosaccharides $G^1$ and/or $G^2$.

Compound (A) and compound (B) can be synthesized as follows. For synthesis of compound (A), it is preferred to react an alcohol of the general formula (III)

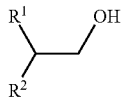

(III)

with a monosaccharide, disaccharide or polysaccharide containing a $G^1$ group in the presence of a catalyst. $R^1$ and $R^2$ are defined in the same way as $R^1$ and $R^2$ in the respective component (A).

For synthesis of compound (B), it is preferred to react an alcohol of the general formula (IV)

$$R^3—CH_2—O—H \quad (IV)$$

with a monosaccharide, disaccharide or polysaccharide containing a $G^2$ group in the presence of a catalyst. $R^3$ is defined in the same way as $R^3$ in the respective component (B).

In both syntheses, basically the same principles may be followed, and they are being referred to as "the synthesis" or "the syntheses" hereafter.

In one embodiment of the present invention, each synthesis is being carried out using a monosaccharide, disaccharide or polysaccharide or mixture of at least two of monosaccharides, di-saccharides and polysaccharides as starting material. For example, in cases in which $G^1$ (or $G^2$, respectively) is glucose, glucose syrup or mixtures from glucose syrup with starch or cellulose can be used as starting material. Polymeric glucose usually requires depolymerisation before conversion with alcohol of general formula (III) or (VIV), respectively. It is preferred, though, to use either a monosaccharide or a disaccharide or a polysaccharide of $G^1$ (or $G^2$, respectively) as starting material.

In one embodiment of the syntheses, alcohol of the general formula (III)—or of general formula (IV), respectively—and monosaccharide, disaccharide or polysaccharide are selected in a molar ratio in the range of from 1.5 to 10 mol alcohol per mol monosaccharide, disaccharide or polysaccharide, preferred 2.3 to 6 mol alcohol per mol monosaccharide, disaccharide or polysaccharide, the moles of monosaccharide, disaccharide or polysaccharide being calculated on the base of the respective $G^1$ or $G^2$ groups.

Catalysts can be selected from acidic catalysts. Preferred acidic catalysts are selected from strong mineral acids, in particular sulphuric acid, or organic acids such as sulfosuccinic acid or aryl sulfonic acids such as para-toluene sulfonic acid. Other examples of acidic acids are acidic ion exchange resins. Preferably, an amount in the range of from 0.0005 to 0.02 mol catalyst is used per mole of sugar.

In one embodiment, the respective synthesis is being performed at a temperature in the range of from 90 to 125° C., preferably from 100 to 115° C., particularly preferred from 102 to 110° C.

In one embodiment of the present invention, the synthesis is carried over a period of time in the range of from 2 to 15 hours.

During performing the synthesis, it is preferred to remove the water formed during the reaction, for example by distilling off water.

In one embodiment, the synthesis is being carried out at a pressure in the range of from 20 mbar up to normal pressure.

In one embodiment, excess alcohol of general formula (III) or (IV) is being distilled off, right after addition of the catalyst.

In another embodiment, at the end of the synthesis, unreacted alcohol of the general formula (III) or (IV), respectively, will be removed, e.g., by distilling it off. Such removal can be started after neutralization of the acidic catalyst with, e. g., a base such as sodium hydroxide or MgO. The temperature for distilling off the excess alcohol is selected in accordance with the alcohol of general formula (III) or (IV), respectively. In many cases, a temperature in the range of from 140 to 215° C. is selected, and a pressure in the range of from 1 mbar to 500 mbar.

In one embodiment, the process according to the invention additionally comprises one or more purification steps. Possible purification steps can be selected from bleaching, e.g., with a peroxide such as hydrogen peroxide, filtering over s adsorbent such as silica gel, and treatment with charcoal.

Formulations according to the invention can be solid, liquid or in the form of slurries. Preferably, formulations according to the invention are selected from liquid and solid formulations. In one embodiment, formulations according to the invention are aqueous, preferably liquid aqueous formulations.

In one embodiment of the present invention, formulations according to the invention can contain 0.1 to 90% by weight of water, based on total of the respective formulation.

In one embodiment of the present invention, formulations according to the invention have a pH value in the range of from zero to 14, preferably from 3 to 11. The pH value can be chosen according to the type of hard surface and the specific application. It is, e.g., preferred to select a pH value in the range of from 3 to 4 for bathroom or toilet cleaners. It is furthermore preferred to select a pH value in the range of from 4 to 10 for dishwashing or floor cleaners. It is furthermore preferred to select a pH value in the range of from 10 to 14 for metal degreasing and for open plant foam cleaning, such as slaughterhouse cleaning and milk and dairy plant cleaning.

In one embodiment of the present invention, formulations according to the invention contain at least one active ingredient. Active ingredients can be selected from soaps, anionic surfactants, such as LAS (linear alkylbenzene sulfonate) or paraffin sulfonates or FAS (fatty alcohol sulfates) or FAES (fatty alcohol ether sulfates), furthermore acids, such as phosphoric acid, amidosulfonic acid, citric acid, lactic acid, acetic acid, other organic and inorganic acids, furthermore organic solvents, such as butyl glycol, n-butoxypropanol, especially 1-butoxy-2-propanol, ethylene glycol, propylene glycol, glycerine, ethanol, monoethanolamine, and isopropanol.

In one embodiment of the present invention, formulations according to the invention comprise at least one organic acid, selected from acetic acid, citric acid, and methanesulfonic acid.

In one embodiment of the present invention, formulations according to the invention contain at least one or more active ingredients selected from non-ionic surfactants which are different from compounds of formulae (I) and (IV). Examples of suitable non-ionic surfactants are alkoxylated n-$C_{10}$-$C_{20}$-fatty alcohols, such as n-$C_{10}$-$C_{20}$-alkyl(EO)$_m$OH with m being in the range of from 5 to 100, furthermore block copolymers of ethylene oxide and propylene oxide, such as poly-EO-poly-PO-poly-EO with $M_w$ in the range of from 3,000 to 5,000 g/mol PO content of from 20 to 50% by mass. Further examples are n-$C_{10}$-$C_{20}$-alkyl(AO)$_m$OH with AO being at least two different alkylene oxides such as combinations from EO and 1,2-butylene oxide or EO and PO, and m being in the range of from 5 to 100.

In one embodiment of the present invention, formulations according to the invention can be used as bath cleaners, as sanitary cleaners, as kitchen cleaners, as toilet cleaners, as toilet bowl cleaners, as sanitary descalers, as all-purpose household cleaners, as all-purpose household cleaner concentrates, as metal degreasers, as all purpose-household spray cleaners, as hand dish cleaners, as automatic dishwashing agents, or floor cleaners, as hand cleaners.

In one embodiment of the present invention, formulations according to the invention can contain at least one biocide or preservative, such as benzalkonium chlorides.

In another embodiment of the present invention, formulations according to the invention can be used as laundry detergents.

In one embodiment of the present invention, formulations according to the invention can contain one or more active ingredients selected from inorganic builders such as phosphates, such as triphosphates.

Phosphate-free formulations according to the present invention are preferred. In the context of the present invention, the term "phosphate-free" refers to formulations with 0.5% by weight of phosphate maximum, based on the total solids content and measured by gravimetric methods, and phosphate-free formulations can contain a minimum of 50 ppm (weight) phosphate or less.

Examples of preferred inorganic builders are silicates, silicates, carbonates, and alumosilicates. Silicates and alumosilicates can be selected from crystalline and amorphous materials.

In one embodiment of the present invention, inorganic builders are selected from crystalline alumosilicates with ion-exchanging properties, such as, in particular, zeolites. Various types of zeolites are suitable, in particular zeolites A, X, B, P, MAP and HS in their Na form or in forms in which Na is partially replaced by cations such as $Li^+$, $K^+$, $Ca^{2+}$, $Mg^{2+}$ or ammonium.

Suitable crystalline silicates are, for example, disilicates and sheet silicates. Crystalline silicates can be used in the form of their alkali metal, alkaline earth metal or ammonium salts, preferably as Na, Li and Mg silicates.

Amorphous silicates, such as, for example, sodium metasilicate, which has a polymeric structure, or Britesil® H20 (manufacturer: Akzo) can be selected.

Suitable inorganic builders based on carbonate are carbonates and hydrogencarbonates. Carbonates and hydrogencarbonates can be used in the form of their alkali metal, alkaline earth metal or ammonium salts. Preferably, Na, Li and Mg carbonates or hydrogencarbonates, in particular sodium carbonate and/or sodium hydrogencarbonate, can be selected. Other suitable inorganic builders are sodium sulphate and sodium citrate.

In one embodiment of the present invention, formulations according to the invention can contain at least one organic complexing agent (organic cobuilders) such as EDTA (N,N,N',N'-ethylenediaminetetraacetic acid), NTA (N,N,N-nitrilotriacetic acid), MGDA (2-methylglycine-N,N-diacetic acid), GLDA (glutamic acid N,N-diacetic acid), and phosphonates such as 2-phosphono-1,2,4-butanetricarboxylic acid, aminotri(methylenephosphonic acid), 1-hydroxyethylene(1,1-diphosphonic acid) (HEDP), ethylenediaminetetramethylenephosphonic acid, hexamethylenediaminetetramethylenephosphonic acid and diethylenetriaminepentamethylenephosphonic acid and in each case the respective alkali metal salts, especially the respective sodium salts. Preferred are the sodium salts of HEDP, of GLDA and of MGDA.

In one embodiment of the present invention, formulations according to the invention can contain one or more active ingredients selected from organic polymers, such as polyacrylates and copolymers of maleic acid-acrylic acid.

In one embodiment of the present invention, formulations according to the invention can contain one or more active ingredients selected from alkali donors, such as hydroxides, silicates, carbonates.

In one embodiment of the present invention, formulations according to the invention can contain one or more further ingredients such as perfume oils, oxidizing agents and bleaching agents, such as perborates, peracids or trichloroisocyanuric acid, Na or K dichloroisocyanurates, and enzymes.

Most preferred enzymes include lipases, amylases, cellulases and proteases. In addition, it is also possible, for example, to use esterases, pectinases, lactases and peroxidases.

Enzyme(s) may be deposited on a carrier substance or be encapsulated in order to protect them from premature decomposition.

In one embodiment of the present invention, formulations according to the invention can contain one or more active ingredients such as graying inhibitors and soil release polymers.

Examples of suitable soil release polymers and/or greying inhibitors are:

Polyesters of polyethylene oxides and ethylene glycol and/or propylene glycol as diol component(s) with aromatic dicarboxylic acids or combinations of aromatic and aliphatic dicarboxylic acids as acid component(s), polyesters of aromatic dicarboxylic acids or combinations of aromatic and aliphatic dicarboxylic acids as acid component(s) with di- or polyhydric aliphatic alcohols as diol component(s), in particular with polyethylene oxide, said polyesters being capped with polyethoxylated $C_1$-$C_{10}$-alkanols.

Further examples of suitable soil release polymers are amphiphilic copolymers, especially graft copolymers of vinyl esters and/or acrylic esters onto polyalkylene oxides. Further examples are modified celluloses such as, for example, methylcellulose, hydroxypropylcellulose and carboxy-methylcellulose.

In one embodiment of the present invention, formulations according to the invention can contain one or more active ingredients selected from dye transfer inhibitors, for example homopolymers and copolymers of vinylpyrrolidone, of vinylimidazole, of vinyloxazolidone or of 4-vinylpyridine N-oxide, each having average molar masses $M_w$ of from 15,000 to 100,000 g/mol, and cross-linked finely divided polymers based on the above monomers.

In one embodiment of the present invention, formulations according to the invention contain 0.1 to 50% by weight, preferably 1 to 20% by weight organic complexing agent, based on the total solids content of the respective formulation.

In one embodiment of the present invention, formulations according to the invention contain 0.1 to 80% by weight, preferably 5 to 55% by weight anionic surfactant, based on the total solids content of the respective formulation.

In one embodiment of the present invention, formulations according to the invention can contain one or more active ingredients selected from defoamers. Examples of suitable defoamers are silicon oils, especially dimethyl polysiloxanes which are liquid at room temperature, without or with silica particles, furthermore microcrystalline waxes and glycerides of fatty acids.

In one embodiment of the present invention, formulations according to the invention do not contain any defoamer which shall mean in the context of the present invention that said formulations according to the invention comprise less than 0.1% by weight of silicon oils and less than 0.1% by weight of glycerides of fatty acids and less than 0.1% by weight of microcrystalline waxes, referring to the total solids content of the respective formulation. In the extreme, formulations according to the invention do not contain any measureable amounts of silicon oils or glycerides of fatty acids at all.

WORKING EXAMPLES

General Remarks

Percentages are % by weight (wt %) unless expressly noted otherwise.

In the context of the present invention, room temperature and ambient temperature both refer to 20° C. unless expressly noted otherwise.

Hazen numbers were determined using solutions of the respective compound of general formula (I) or (II) in 10% by weight solutions, with mixtures of 90% by weight of water and 10% by weight of isopropanol as solvent. Only if a turbid mixture was formed, a mixture of 80% by weight of water and 20% by weight of isopropanol was used. A round vessel (11 mm diameter) was used as cuvette. The colour was then determined with a spectrophotometer Dr. Lange Lico 200 according to the user's manual.

(A.2) was synthesized as follows:

As alcohol (III.1), the following compound was used:

(III.1)

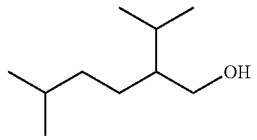

It was obtained by a Guerbet reaction of iso-amyl alcohol. It had an impurity of 10 mol-% of (III.1a)

(III.1a)

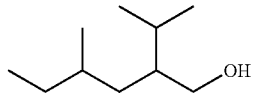

It was thus a 9:1 mixture of isomers hereinafter also being referred to as "alcohol mixture (III.1)".

A jacketed 4 l glass reactor equipped with a condenser with a Dean-Stark trap, a three stage agitator, a distillation receiver and a dropping funnel was charged with 703.6 g (2.4 moles) of glucose monohydrate and 1250 g of alcohol mixture (III.1). The resultant slurry was dried at 75° C. at a pressure of 30 mbar for a period of 30 minutes under stirring. Then, the pressure was adjusted to ambient pressure, and the slurry was heated to 90° C. An amount of 2.14 g of concentrated sulfuric acid (96% by weight), dissolved in 100 g of alcohol mixture (III.1), was added and heating was continued until a temperature of 106° C. was reached. The pressure was set to 30 mbar, and, under stirring, the water formed was distilled off at the Dean-Stark trap equipped with cold traps. After 5.5 hours, no more water was formed, and the amount of water to be formed theoretically was in the cold traps.

The reaction was then quenched by neutralizing the catalyst with 2.6 g of 50% by weight aqueous NaOH. The pH value, measured in a 10% solution in isopropanol/water (1:10), was at least 9.5. The reaction mixture was then transferred into a round flask, excess alcohol mixture (III.1) was distilled off at 140° C./1 mbar. During the removal of the excess alcohol mixture (III.1), the temperature was step-wise raised to 180° C. within 2 hours. When no more alcohol would distil off, the liquid reaction mixture was stirred into water (room temperature) in order to adjust the solids content to 60% and cooled to ambient temperature, hereby forming an aqueous paste. The compound (A.2) had a degree of polymerization (number average) of 1.3 and a residual alcohol content of 0.04 g, and the paste so obtained had a water content of 40.8%. The pH value was 4.1, the colour number (Gardner) was 16.3.

In order to improve the colour, 800 g of the above aqueous paste were transferred into a 4 l vessel and reacted with 38.5 g of 35% by weight aqueous $H_2O_2$ which was added in a way that the total peroxide content was in the range of from 300 to 1,500 ppm, determined with Merckoquant peroxide test sticks. The pH value was maintained in the range from 7.5 to 8. Finally, the pH value was adjusted to 11.5 with 50% by weight aqueous NaOH. The colour number (Gardner) had dropped to 2.9, and the water content had raised to 45.9%. All measurements with respect to pH value and peroxide content were performed on a 10% by volume diluted paste. For dilution, a 15% by volume aqueous solution of isopropanol was used.

The following alkyl polyglucosides were used:

(A.1): 2-n-propyl heptyl glucoside: $G^1$=glucose, x=1.4, $R^1$=n-$C_3H_7$, $R^2$=n-$C_5H_{11}$ (A.2): 2-isopropyl 5-methylhexyl glucoside, $G^1$=glucose, x=1.3, $R^1$=iso-$C_3H_7$, $R^2$=iso-$C_5H_{11}$ (B.1): 2-ethylhexyl glucoside, $G^2$=glucose, y=1.4, $R^3$=$CH(C_2H_5)$—$(CH_2)_2CH_3$ (B.2): n-hexyl glucoside, $G^2$=glucose, y=1.4, $R^3$=n-$C_5H_{11}$ (B.3): isoamyl glucoside, $G^2$=glucose, y=1.4, $R^3$=$(CH_2)_2CH(CH_3)_2$ (B.4): n-butyl glucoside, $G^2$=glucose, y=1.4, $R^3$=n-$C_3H_7$ The values of x and y were calculated based on the glucoside distribution determined by high temperature gas chromatography (HTGC), e.g. 400° C., in accordance with K. Hill et al., Alkyl Polyglycosides, VCH Weinheim, New York, Basel, Cambridge, Tokyo, 1997, in particular pages 28 ff., with Duran glass as capillary material.

I. Formation of Mixtures According to the Invention and of Comparative Mixtures

The respective compounds (A) and (B) were each dissolved in water to form 50% by weight of aqueous solutions. One solution of a compound (A) and one of a compound (B) were combined in the desired mass ratio in a beaker with magnetic stirring. Depending on the ratio of the compounds (A) and (B), mixture according to the invention or comparative mixtures were obtained according to table 1 as clear aqueous solutions.

Samples of the respective mixtures were stored at ambient temperature for twelve weeks and then evaluated visually.

As additional comparison, 50% by weigh aqueous solutions with pure (A.1) and pure (A.2) each were stored at ambient temperature for twelve weeks and then evaluated visually. Both the solutions were turbid.

The results are summarized in table 1.

TABLE 1 mixtures according to the invention, comparative mixtures and their storage behaviour

| Name | (A) | (B) | mass ratio (A):(B) | Stability (20° C.) |
|---|---|---|---|---|
| C-(M-1.1-8/1) | (A.1) | (B.1) | 8:1 | turbid |
| (M-1.1-2/1) | (A.1) | (B.1) | 2:1 | clear |
| (M-1.1-1/1) | (A.1) | (B.1) | 1:1 | clear |
| C-(M-1.2-4/1) | (A.1) | (B.2) | 8:1 | turbid |
| (M-1.2-4/1) | (A.1) | (B.2) | 4:1 | clear |
| (M-1.2-2/1) | (A.1) | (B.1) | 2:1 | clear |
| (M-1.2-1/1) | (A.1) | (B.1) | 1:1 | clear |
| C-(M-1.3-8/1) | (A.1) | (B.3) | 8:1 | turbid |
| (M-1.3-4/1) | (A.1) | (B.3) | 4:1 | clear |
| (M-1.3-2/1) | (A.1) | (B.3) | 2:1 | clear |
| (M-1.3-1/1) | (A.1) | (B.3) | 1:1 | clear |
| C-(M-1.4-8/1) | (A.1) | (B.4) | 8:1 | turbid |
| (M-1.4-4/1) | (A.1) | (B.4) | 4:1 | clear |
| (M-1.4-2/1) | (A.1) | (B.4) | 2:1 | clear |
| (M-1.4-1/1) | (A.1) | (B.4) | 1:1 | clear |
| C-(M-2.1-8/1) | (A.2) | (B.1) | 8:1 | turbid |
| (M-2.1-2/1) | (A.2) | (B.1) | 2:1 | clear |
| (M-2.1-1/1) | (A.2) | (B.1) | 1:1 | clear |
| C-(M-2.2-4/1) | (A.2) | (B.2) | 8:1 | turbid |
| (M-2.2-4/1) | (A.2) | (B.2) | 4:1 | clear |
| (M-2.2-2/1) | (A.2) | (B.2) | 2:1 | clear |
| (M-2.2-1/1) | (A.2) | (B.2) | 1:1 | clear |
| C-(M-2.3-8/1) | (A.2) | (B.3) | 8:1 | turbid |
| (M-2.3-4/1) | (A.2) | (B.3) | 4:1 | clear |
| (M-2.3-2/1) | (A.2) | (B.3) | 2:1 | clear |
| (M-2.3-1/1) | (A.2) | (B.3) | 1:1 | clear |
| C-(M-2.4-8/1) | (A.2) | (B.4) | 8:1 | turbid |
| (M-2.4-4/1) | (A.2) | (B.4) | 4:1 | clear |
| (M-2.4-2/1) | (A.2) | (B.4) | 2:1 | clear |
| (M-2.4-1/1) | (A.2) | (B.4) | 1:1 | clear |

II. Cleaning Properties of Mixtures According to the Invention and of Comparative Mixtures Test Soil:

36 wt % white spirit (boiling range 80/110°);

17 wt % triglyceride (commercially available Myritol® 318);

40 wt % mineral oil (commercially available Nytex® 801), 7 wt % carbon black.

For preparing the test soil, a beaker was charged with the white spirit. The triglyceride and the mineral oil were added under stirring (500 rpm) until a clear solution had formed. The carbon black was then slowly added. The dispersion so obtained was then stirred for 30 minutes with an IKA Ultra-Turrax® T25 digital—basic. Thereafter, the dispersion was then stirred with a magnetic stirrer for 21 days at ambient temperature and then for 30 minutes with the Ultra-Turrax specified above. The dispersion so obtained was then stored in a closed glass bottle for additional 14 days under ambient conditions while being continuously stirred on a magnetic stirring device. The test soil so obtained was then ready for use.

As test substrates, white PVC stripes (37·423·1.2 mm) (commercially available from Gerrits, PVC-Tanzteppich® 5410 Vario white) were used.

As test cleaners, the amounts of mixture according to the invention or of comparative mixture according to tables 1 and 2 were dissolved in 50 ml of water. The pH value was adjusted to 7 with 0.1 M NaOH or 0.1 M acetic acid, if necessary. Then, the total mass of each of the test cleaners was adjusted to the total mass of 100 g (±0.2) g by addition of distilled water.

The tests were Gardner tests performed in an automatic test robot. It contained a sponge (viscose, commercially available as Spontex® Z14700), cross section 9·4 cm. Per run, 5 test stripes were first soiled with 0.28 (±0.2) g of test soil by brush and then dried at ambient temperature for one hour. Then they were treated with the humid sponge, soaked with 20 ml of test cleaner, swaying ten times with a weight of 300 g and a swaying velocity 10 m/s, followed by rinsing twice with distilled water and drying at ambient temperature for 4 hours. For each test stripe, a new sponge was used. The soiling and de-soiling were each recorded with a digital camera.

TABLE 2

Test cleaners and their performance

| Name | Mixture tested | (A), (B) | Ratio (A)/(B) | solids content | Soil removal [%] | Standard deviation [%] |
|---|---|---|---|---|---|---|
| C-TC.1 | — | (A.1) | 100:0 | 1.0 | 83.3 | 3.4 |
| C-TC.2 | — | (A.1) | 100:0 | 2.0 | 87.0 | 4.6 |
| TC.3 | (M-1.1-2/1) | (A.1), (B.1) | 2:1 | 1.0 | 83.3 | 5.0 |
| TC.4 | (M-1.1-2/1) | (A.1), (B.1) | 2:1 | 2.0 | 81.3 | 4.6 |
| TC.5 | (M-1.1-1/1) | (A.1), (B.1) | 1:1 | 1.0 | 78.0 | 4.3 |
| TC.6 | (M-1.1-1/1) | (A.1), (B.1) | 1:1 | 2.0 | 75.1 | 5.2 |
| C-TC.7 | — | (B.1) | 0:100 | 0.5 | 28.6 | 1.5 |
| C-TC.8 | — | (B.1) | 0:100 | 1.0 | 43.5 | 1.8 |
| C-TC.9 | — | (B.1) | 0:100 | 2.0 | 54.8 | 2.4 |

The solids content refers to the test cleaner and is expressed in g solids/100 g.

The standard deviation refers to the 5 PVC stripes tested per run with the same cleaner and the same soil.

The invention claimed is:

1. A mixture, comprising:

(A) from 15 to 85% by weight of at least one compound of formula (I):

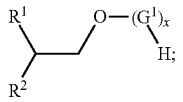

(I)

and (B) from 85 to 15% by weight of at least one compound of formula (II);

$$R^3—CH_2—O-(G^2)_y-H \quad (II),$$

wherein:

$R^1$ is $C_3$-$C_4$-alkyl, linear or branched, $R^2$ is $C_5$-$C_6$-alkyl, linear or branched, $G^1$, $G^2$ are each independently monosaccharides with 4 to 6 carbon atoms, x, y are 1.4, $R^3$ is $C_3$-$C_9$-alkyl, linear or branched, wherein the percentages of compound (A) and compound (B) refer to the total mixture, and compound (A) is different from compound (B).

2. The mixture of claim 1, wherein $G^1$ and $G^2$ are selected from the group consisting of glucose, arabinose, and xylose.

3. The mixture of claim 1, wherein $R^3$ is selected from the group consisting of $CH(C_2H_5)—(CH_2)_3—CH_3$, n-heptyl, and n-nonyl.

4. The mixture according to claim 1, comprising at least two of the compounds (A).

5. The mixture of claim 1, wherein in one compound (A), $R^1$ is isopropyl and $R^2$ is $CH_2—CH_2—CH(CH_3)_2$.

6. The mixture of claim 1, wherein in one compound (A), $R^1$ is n-$C_3H_7$ and $R^2$ is n-$C_5H_{11}$.

7. A process for making the mixture of claim 1, comprising mixing at least one compound (A) with at least one compound (B).

8. A process for cleaning a hard surface or fiber, comprising contacting the mixture of claim 1 with the hard surface or fiber.

9. The process of claim 8, further comprising a degreasing.

10. An aqueous formulation, comprising:

from 35 to 80% by weight of the mixture of claim 1; and water.

11. The aqueous formulation of claim 10, further comprising a by-product, stemming from the synthesis of compound (A) or compound (B).

12. The mixture of claim 1, which is a clear mixture.

13. The aqueous formulation of claim 10, which is a clear aqueous formulation.

14. The mixture of claim 1, which is a clear mixture as determined by a Hazen number for a clear liquid and measured according to DIN EN ISO 6271-1 or 6271-2.

15. A mixture, comprising:

(A) from 15 to 85% by weight of at least one compound of formula (I):

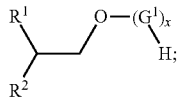

(I)

and (B) from 85 to 15% by weight of at least one compound of formula (II):

$$R^3—CH_2—O-(G^2)_y-H \quad (II),$$

wherein:

$R^1$ is $C_3$-$C_4$-alkyl, linear or branched, $R^2$ is $C_5$-$C_6$-alkyl, linear or branched, $G^1$, $G^2$ are each independently monosaccharides with 4 to 6 carbon atoms, x, y are numbers in the range of from 1.1 to 4, $R^3$ is a branched $C_3$-$C_6$-alkyl or a linear $C_3$-$C_4$ alkyl, wherein the percentages of compound (A) and compound (B) refer to the total mixture, and compound (A) is different from compound (B).

16. The mixture of claim 15, wherein $R^3$ is a branched $C_3$-$C_6$-alkyl.

17. An aqueous formulation, comprising:

from 35 to 80% by weight of the mixture of claim 15; and water.

18. The mixture of claim 15, wherein in molecules with x or y, respectively, being 2 or more, the sugar molecules are linked in 1,4-position(s).

* * * * *